US010030356B2

(12) United States Patent
May

(10) Patent No.: US 10,030,356 B2
(45) Date of Patent: Jul. 24, 2018

(54) STRUT ASSEMBLY OF MACHINE

(71) Applicant: Caterpillar Inc., Peoria, IL (US)

(72) Inventor: Michael P. May, Wamego, KS (US)

(73) Assignee: Caterpillar Inc., Deerfield, IL (US)

( * ) Notice: Subject to any disclaimer, the term of this patent is extended or adjusted under 35 U.S.C. 154(b) by 53 days.

(21) Appl. No.: 15/055,889

(22) Filed: Feb. 29, 2016

(65) Prior Publication Data

US 2017/0247855 A1 Aug. 31, 2017

(51) Int. Cl.

*E02F 3/815* (2006.01)
*E02F 3/76* (2006.01)
*E02F 3/84* (2006.01)

(52) U.S. Cl.

CPC ..... *E02F 3/8157* (2013.01); *E02F 3/764* (2013.01); *E02F 3/7659* (2013.01); *E02F 3/844* (2013.01)

(58) Field of Classification Search

CPC ..... E02F 3/8157; E02F 3/764; E02F 3/7659; E02F 3/844; E02F 9/24; A01B 61/00; A01B 61/04; A01B 61/042

See application file for complete search history.

(56) References Cited

U.S. PATENT DOCUMENTS 2,332,712 A 10/1943 Gustafson et al.
2,643,470 A 6/1953 Kaeser
2,991,566 A * 7/1961 Sumner ..... E01H 5/063 37/232
3,242,599 A * 3/1966 Iverson ..... E02F 3/38 172/477
3,388,929 A * 6/1968 Miley ..... B62D 49/04 172/817
4,214,635 A * 7/1980 van der Lely ..... A01B 61/042 172/103
4,258,484 A 3/1981 Lansard
4,596,081 A 6/1986 DeBilly et al.
5,245,771 A * 9/1993 Walsh ..... E01H 5/068 172/484
5,560,129 A * 10/1996 Rothbart ..... B66F 9/12 37/231
6,249,992 B1 6/2001 Irving et al.
(Continued)

FOREIGN PATENT DOCUMENTS

CA 1114915 12/1981
CA 2609722 6/2015
(Continued)

*Primary Examiner* — Matthew D. Troutman
(74) *Attorney, Agent, or Firm* — Bart A. Fisher

(57) ABSTRACT

A strut assembly for coupling an implement to a frame of a machine is provided. The strut assembly includes a first elongated member configured to couple to the frame of the machine. The strut assembly further includes a second elongated member slidably disposed within the first elongated member. The second elongated member is configured to couple to the implement. The strut assembly further includes a shear system configured to engage the second elongated member with the first elongated member. The shear system includes a first shear pin configured to be inserted through a first opening defined in the first elongated member and a second opening defined in the second elongated member. The first shear pin includes a first fracture zone positioned within a gap defined between the first elongated member and the second elongated member.

16 Claims, 18 Drawing Sheets

(56) References Cited

U.S. PATENT DOCUMENTS

| | | | |
|---|---|---|---|
| 6,412,200 | B1 | 7/2002 | Savard |
| 6,581,307 | B1 | 6/2003 | Jones et al. |
| 7,000,338 | B2 | 2/2006 | Savard |
| 7,523,569 | B2 | 4/2009 | Savard |
| 8,499,477 | B2 | 8/2013 | Gamble, II |
| 8,596,376 | B2 | 12/2013 | Holverson et al. |
| 8,732,990 | B1 | 5/2014 | Danreuther |
| 8,776,406 | B2 | 7/2014 | Stephan |
| 8,850,724 | B2 | 10/2014 | Bioxdorf |
| 8,887,412 | B2 | 11/2014 | Proeber et al. |
| 9,085,859 | B2 | 7/2015 | Andic |
| 2013/0160333 | A1 | 6/2013 | Becicka et al. |
| 2014/0068975 | A1 | 3/2014 | Dubiel |
| 2014/0102737 | A1 | 4/2014 | Isbill |
| 2014/0290101 | A1 | 10/2014 | Arsenault et al. |
| 2015/0292171 | A1 | 10/2015 | May et al. |

FOREIGN PATENT DOCUMENTS

| | | |
|---|---|---|
| JP | 2000054334 | 2/2000 |
| JP | 3170683 | 5/2001 |

* cited by examiner

STRUT ASSEMBLY OF MACHINE

TECHNICAL FIELD

The present disclosure relates to a strut assembly for coupling an implement to a frame of the machine.

BACKGROUND

Machines, such as motor graders, are generally used for clearing materials, such as snow, accumulated on road surface or any other ground surfaces. For example, the motor grader includes an implement, such as a snow wing plow, attached to a frame of the motor grader in proximity to an operator cabin. The implement is coupled to the motor grader in a manner to extend a lateral snow plowing reach of the motor grader. In addition, the implement extends at an angle to a longitudinal axis of the motor grader for engaging with the ground surface. During snow plowing, an operator of the motor grader needs to watch for obstacles along the ground surface and raise the implement, to avoid striking the obstacles. However, in cases where the obstacles are buried by snow, or visibility is otherwise poor making it difficult for the operator to see the obstacle, striking of the implement with the obstacles may lead to application of high magnitude load on the implement. Accordingly, there is a need for the implement to uncouple from the frame of the machine to withstand the applied load and prevent the load from being transmitted to the frame of the machine.

JP Patent Number 3170683 (the '683 patent) discloses separated pieces of a shear pin from falling by freely fitting C-shaped rings into grooves in shear pin bushes so that inner diameters of the rings are slightly smaller than an outer diameter of the shear pin. The C-shaped rings are freely fitted into fitting grooves for the C-shaped rings inside of shear pin bushes. When the shear pin is inserted into the C-shaped rings, a suitable tightening force is generated by an elastic action of the C-shaped rings, and tightens and holds the shear pin. After the insertion, the shear pin is fixed at a position by a lock pin. In the shear pin bushes, side faces with high hardness agrees with shearing grooves of the shear pin by heat treatment. When the shear pin reaches the limitation of its shearing stress caused by overload on a body, the shear pin is sheared and separated.

SUMMARY OF THE DISCLOSURE

According to an aspect of the present disclosure, a strut assembly for coupling an implement to a frame of a machine is provided. The strut assembly includes a first elongated member configured to couple to the frame of the machine. The strut assembly further includes a second elongated member slidably disposed within the first elongated member. The second elongated member is configured to couple to the implement. The strut assembly further includes a shear system configured to engage the second elongated member with the first elongated member. The shear system includes a first shear pin configured to be inserted through a first opening defined in the first elongated member and a second opening defined in the second elongated member. The first shear pin includes a first fracture zone positioned within a gap defined between the first elongated member and the second elongated member.

In another aspect of the present disclosure, a strut assembly for coupling an implement to a frame of a machine is provided. The strut assembly includes a first elongated member configured to couple to the frame of the machine.

The strut assembly further includes a second elongated member slidably disposed within the first elongated member. The second elongated member is configured to couple to the implement. The strut assembly further includes a linear actuator coupled to the frame of the machine, and is configured to move the first elongated member relative to the frame. The strut assembly further includes a first shear system configured to engage the second elongated member with the first elongated member. The first shear system includes a first shear pin supported on a clamping member, and is configured to be inserted through a first opening defined in the first elongated member and a second opening defined in the second elongated member. The first shear pin includes a first fracture zone positioned within a gap defined between the first elongated member and the second elongated member. The strut assembly further includes a second shear system configured to engage the second elongated member with the linear actuator. The second shear system includes a first mounting bracket coupled to the first elongated member. The second shear system further includes a second mounting bracket coupled to the linear actuator, and is slidably received within the first mounting bracket. The second shear system further includes a sliding pin coupled to the second mounting bracket, and is configured to slidably receive through an elongated slot defined in the first mounting bracket. The second shear system further includes a shear member configured to be inserted through a first hole defined in the first mounting bracket and a second hole defined in the second mounting bracket, and is configured to engage the first mounting bracket with the second mounting bracket.

In yet another aspect of the present disclosure, a machine is provided. The machine includes a frame and a first elongated member configured to couple to the frame. The strut assembly further includes a second elongated member slidably disposed within the first elongated member. The second elongated member is configured to couple to the implement. The strut assembly further includes a linear actuator coupled to the frame of the machine, and is configured to move the first elongated member relative to the frame. The strut assembly further includes a first shear system configured to engage the second elongated member with the first elongated member. The first shear system includes a first shear pin supported on a clamping member, and is configured to be inserted through a first opening defined in the first elongated member and a second opening defined in the second elongated member. The first shear pin includes a first fracture zone positioned within a gap defined between the first elongated member and the second elongated member. The strut assembly further includes a second shear system configured to engage the second elongated member with the linear actuator. The second shear system includes a first mounting bracket coupled to the first elongated member. The second shear system further includes a second mounting bracket coupled to the linear actuator, and is slidably received within the first mounting bracket. The second shear system further includes a sliding pin coupled to the second mounting bracket, and is configured to slidably receive through an elongated slot defined in the first mounting bracket. The second shear system further includes a shear member configured to be inserted through a first hole defined in the first mounting bracket and a second hole defined in the second mounting bracket, and is configured to engage the first mounting bracket with the second mounting bracket.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
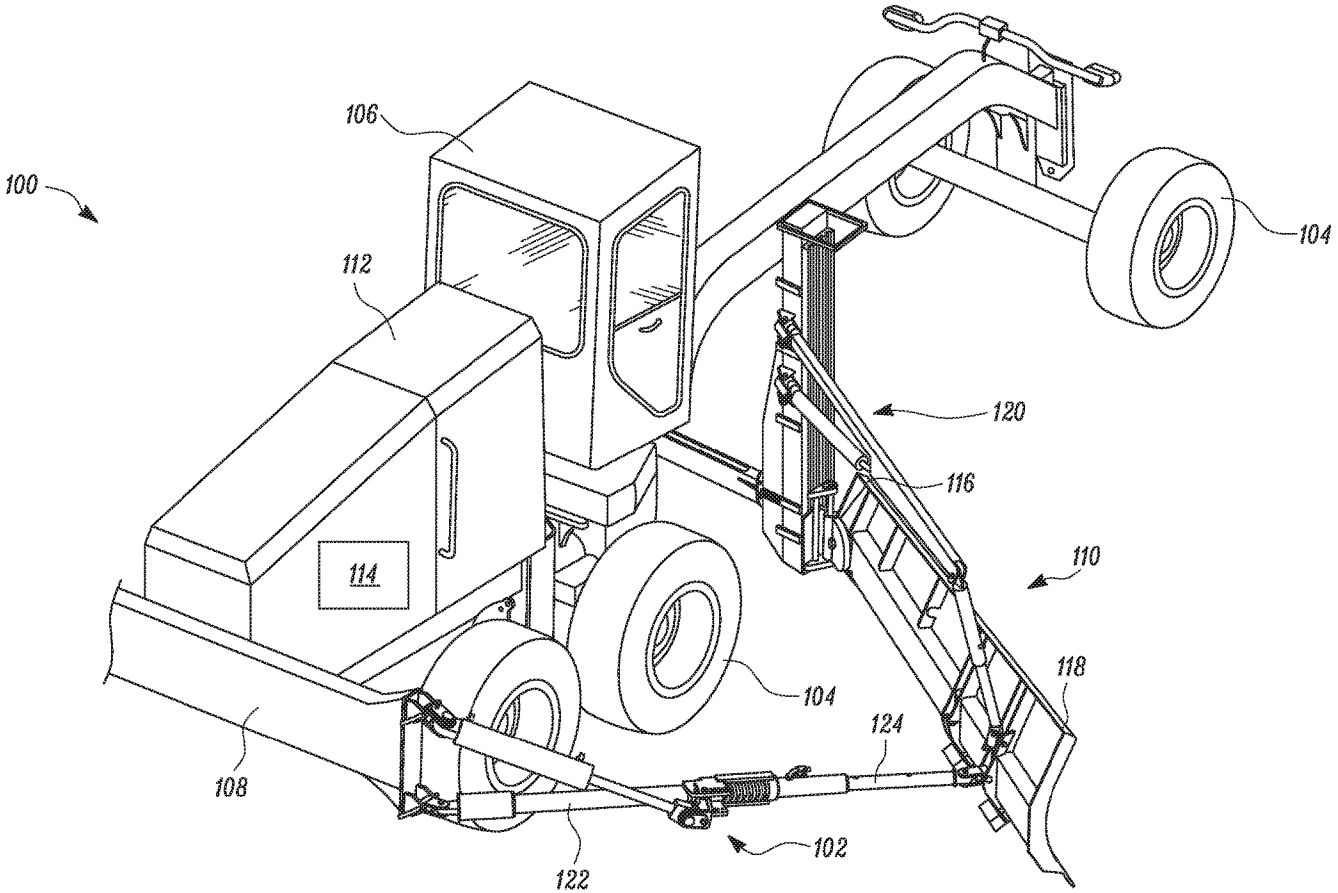
FIG. 1 is a perspective view of a machine having a strut assembly for coupling an implement to a frame, according to an embodiment of the present disclosure.

FIG. 1 illustrates a perspective view of a machine 100 having a strut assembly 102, according to an embodiment of the present disclosure. The machine 100 is embodied as a motor grader. The machine 100 is supported on a set of ground engaging members 104, such as wheels. The set of ground engaging members 104 is in contact with a ground surface to move the machine 100 over the ground surface. The machine 100 further includes an operator cab 106 supported on a frame 108. The operator cab 106 may include an operator interface (not shown) having control levers, switches, and a display, such that an operator may control movement of the machine 100 to perform various operations. The machine 100 further includes an implement 110 for performing various earth moving operations, such as cutting and leveling of the ground surface. The implement 110 is attached to the frame 108. The machine 100 may include a power source, such as an engine disposed within an engine compartment 112 to supply power to various components including, but not limited to, the set of ground engaging members 104 and the implement 110.

The machine 100 further includes a hydraulic system 114 for actuating the implement 110 and other operating systems including, but not limited to, a steering system of the machine 100. The hydraulic system 114 may include various components including, but not limited to, a reservoir, one or more hydraulic pumps, one or more direction control valves, and other control valves for supplying hydraulic fluid at a desired pressure to the various components of the machine 100. The one or more hydraulic pumps of the hydraulic system 114 are operatively coupled with the engine to receive power therefrom to supply pressurized hydraulic fluid.

The implement 110 of the machine 100 is used for removing materials, such as snow or soil, from the ground surface or the roadways. Further, the implement 110 is coupled to one side of the machine 100, such that the materials lying on the side of the machine 100 may be removed. The implement 110 may be used for removing the materials from the ground surface to a width greater than a width of the machine 100. The implement 110 includes a first end 116 and a second end 118. The first end 116 of the implement 110 is coupled to the frame 108 of the machine 100, via a linkage assembly 120. The linkage assembly 120 is configured to raise and lower the implement 110 with respect to the ground surface. Further, the linkage assembly 120 is configured to move the implement 110 to various angular positions with respect to the frame 108. The second end 118 of the implement 110 is coupled to the frame 108 via the strut assembly 102, as shown in FIG. 1.

The strut assembly 102 is configured to move the implement 110 with respect to the linkage assembly 120 to the various angular positions. The strut assembly 102 includes a first elongated member 122 and a second elongated member 124 slidably disposed within the first elongated member 122. The first elongated member 122 is configured to couple to the frame 108 of the machine 100 and the second elongated member 124 is configured to couple to the implement 110.

The strut assembly 102 and the linkage assembly 120 are in fluid communication with the hydraulic system 114 of the machine 100. Based on an operator input, the hydraulic system 114 aids in actuation of the strut assembly 102 and the linkage assembly 120, thereby causing the implement 110 to move with respect to the ground surface during material removal operations.

Figure 2:
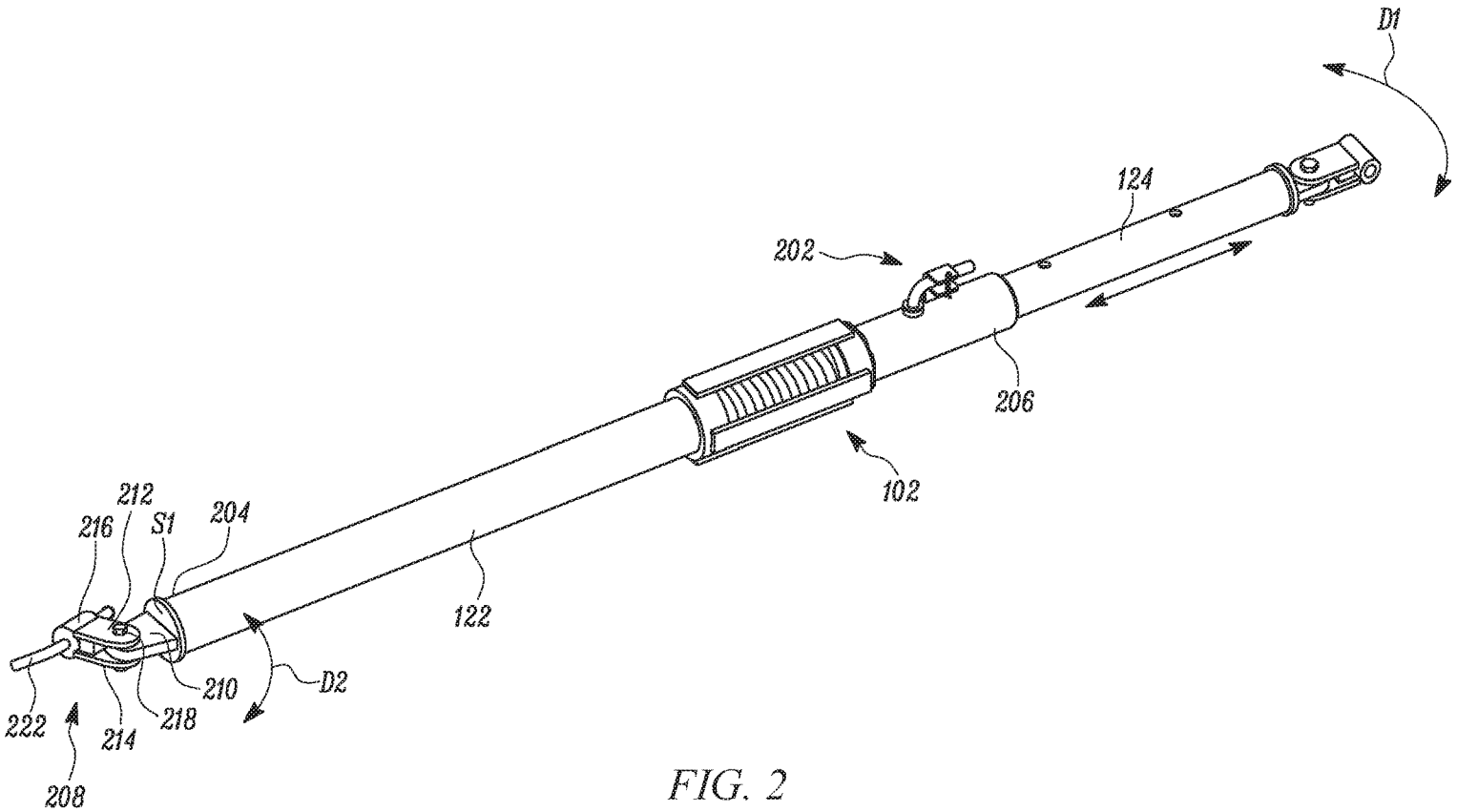
FIG. 2 is a perspective view of the strut assembly of FIG. 1, according to an embodiment of the present disclosure.

FIG. 2 is a perspective view of the strut assembly 102 of FIG. 1 having a shear system 202, according to one embodiment of the present disclosure. The shear system 202 is hereinafter referred to as "the first shear system 202". The first elongated member 122 has a first end 204 and a second end 206. The first end 204 is coupled to the frame 108 of the machine 100 through a first connecting link 208. The first end 204 of the first elongated member 122 includes a first extended member 210 that extends in a direction perpendicular to a surface 'S1' of the first end 204. The first connecting link 208 includes a first connecting arm 212 and a second connecting arm 214 attached to a hub 216. The first extended member 210 is configured to be inserted between the first connecting arm 212 and the second connecting arm 214, and coupled by a first fastener 218. Owing to such arrangement, the first elongated member 122 moves in a horizontal plane, and in a first direction "D1" about the first fastener 218. Furthermore, the hub 216 is configured to couple to the frame 108 through a pair of brackets (not shown) and a first pin member 222. The pair of brackets may be attached to the frame 108 of the machine 100. The first pin member 222 allows movement of the first elongated member 122 in a vertical plane, and in a second direction "D2", about the first pin member 222. Therefore, the first elongated member 122 can move in the first direction "D1" and the second direction "D2" during the material removal operation. Therefore, in the present embodiment, the first elongated member 122 is configured to move with two-degrees of freedom. However, it may be understood that the first connecting link 208 may be designed in such a way to move the first elongated member 122 with multiple degrees of freedom. The strut assembly 102 includes the first shear system 202 to engage the second elongated member 124 with the first elongated member 122.

Figure 3:
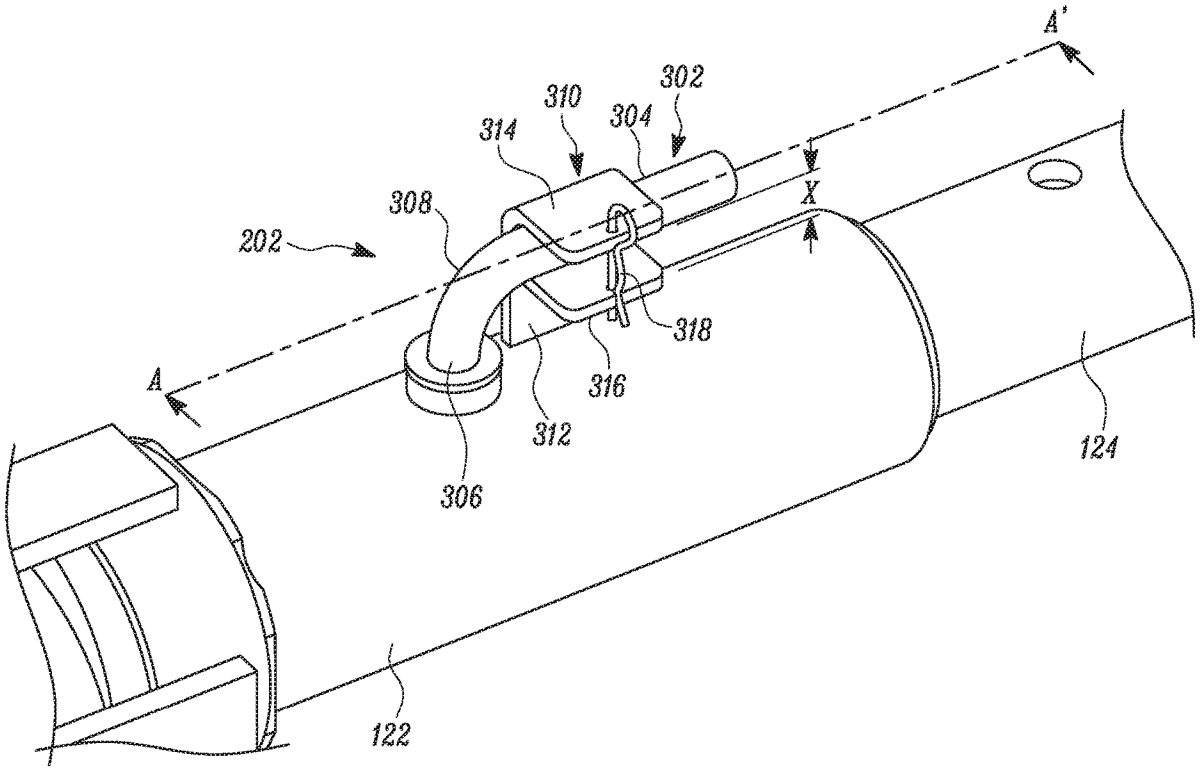
FIG. 3 is an enlarged view of a first shear system of the strut assembly, according to an embodiment of the present disclosure.

An enlarged view of the first shear system 202 is shown in FIG. 3. The first shear system 202 includes a first shear pin 302 to engage the first elongated member 122 with the second elongated member 124. The first shear pin 302 includes a first portion 304 and a second portion 306 that extends in a direction perpendicular to the first portion 304. As such, the first shear pin 302 is bent at a 90 degree angle to form the first portion 304 and the second portion 306. Further, the second portion 306 is differentiated from the first portion 304 by an arcuate portion 308 that is formed during bending of the first shear pin 302. In an embodiment, the first shear system 202 further includes a holding member 310 to support and position the first portion 304, when the first shear pin 302 is employed to engage the first elongated member 122 with the second elongated member 124. The holding member 310 is hereinafter referred to as 'the first holding member 310'.

The first holding member 310 is mounted on the first elongated member 122 and configured to removably receive the first portion 304 of the first shear pin 302. For the purpose of supporting the first portion 304, the first holding member 310 includes a support member 312, and a first arm 314 and a second arm 316 extending from the support member 312. The support member 312 is fixed on the first elongated member 122 and extends from a surface of the first elongated member 122. Further, the first arm 314 and the second arm 316 extend in a direction perpendicular to the support member 312, such that the first arm 314 and the second arm 316 are separated by a distance 'X'. In an example, the distance 'X' may be equal to or greater than a diameter of the first portion 304 of the first shear pin 302. That is, the first portion 304 of the first shear pin 302 may be inserted between the first arm 314 and the second arm 316 of the first holding member 310.

Although FIG. 3 shows the first shear pin 302 having a circular cross-section, it will be understood by a person skilled in the art that the cross-section of the first portion 304 may be, but not limiting to, a square, a rectangle, an oval, and a polygon. In another example, the first portion 304 may include a linearly varying cross-section and, in such cases, the first arm 314 and the second arm 316 may be fixed to the support member 312 in a manner to removably receive the first portion 304 therebetween. Further, in an embodiment, the first holding member 310 may include a securing device 318 to secure or hold the first portion 304 of the first shear pin 302 between the first arm 314 and the second arm 316. In the present embodiment, the securing device 318 is a cotter pin. In another embodiment, the first arm 314 and the second arm 316 may be made from a resilient member. In such a case, the securing device 318 may be a clip that is configured to compress free ends of the first arm 314 and the second arm 316 after the first portion 304 of the first shear pin 302 is inserted therebetween.

Figure 4:
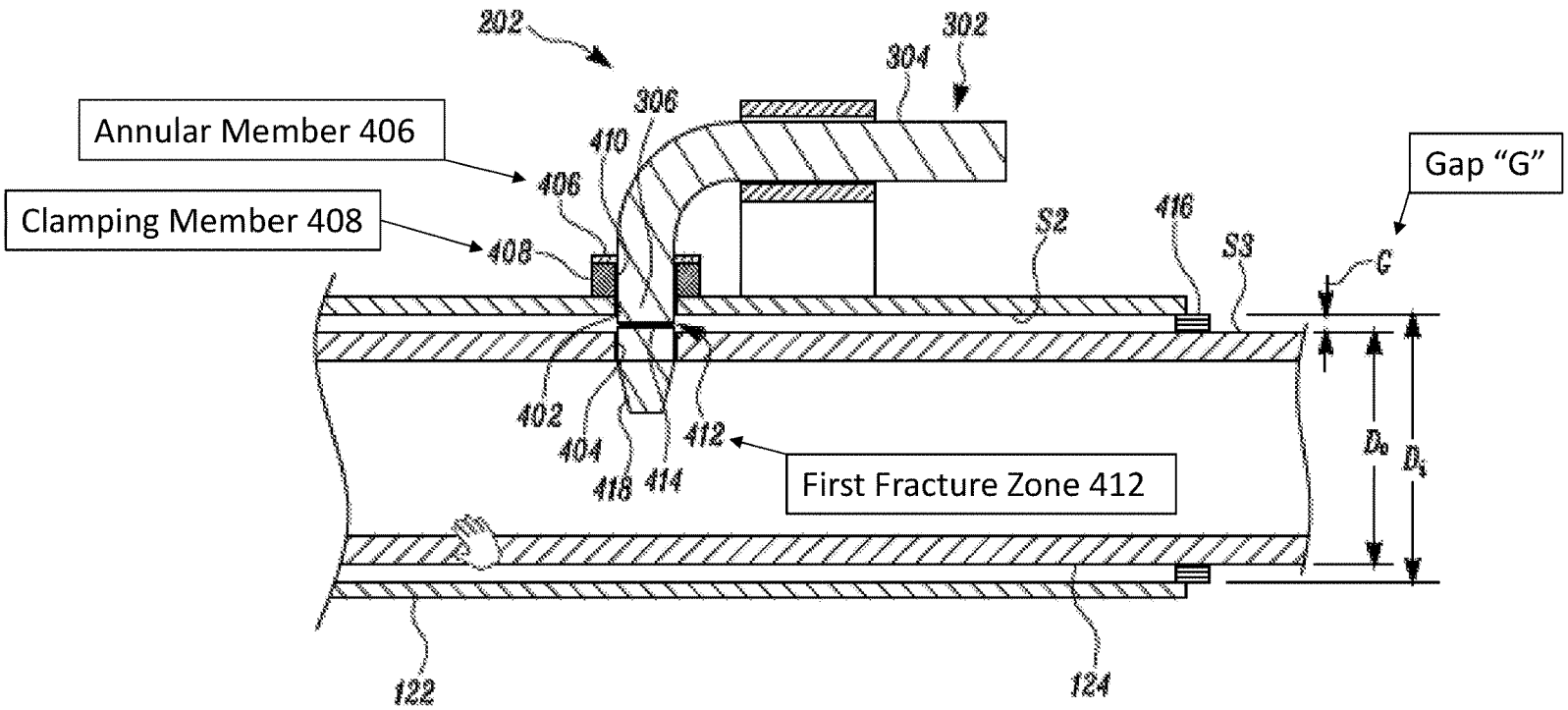
FIG. 4 is a cross-section of the first shear system taken along a line A-A', according to an embodiment of the present disclosure.

Coupling of the first elongated member 122 with the second elongated member 124 by the first shear pin 302 will be described with reference to FIG. 4. A cross-section of the first shear system 202, taken along a line A-A' in FIG. 3, is shown in FIG. 4. In one implementation, the first elongated member 122 includes a first opening 402 and the second elongated member 124 includes a second opening 404. Although FIG. 4 illustrates the first opening 402 as a circular opening, it will be understood that a shape of periphery of the first opening 402 and the second opening 404 may correspond to the cross-section of the second portion 306 of the first shear pin 302. During assembling of the strut assembly 102, the first opening 402 is aligned with the second opening 404. Further, as mentioned earlier, the second portion 306 of the first shear pin 302 extends in the direction perpendicular to the first portion 304. The second portion 306 is extending through the first opening 402 defined in the first elongated member 122. For instance, the second portion 306 of the first shear pin 302 may be inserted into the aligned first opening 402 and the second opening 404, such that the second portion 306 extend through the first opening 402, as shown in FIG. 4.

The first shear system 202 further includes an annular member 406 coupled to the second portion 306 of the first shear pin 302. In one example, the annular member 406 may be embodied as a spacer, such that the second portion 306 of the first shear pin 302 passes coaxially through the spacer. In another example, the annular member 406 may be embodied as fins that protrude from the surface of the second portion 306 of the first shear pin 302. Further, in an embodiment, the first shear system 202 includes a first clamping member 408 configured to position the first shear pin 302 at a predetermined depth in the first elongated member 122 and the second elongated member 124. The first clamping member 408 is embodied as a cylindrical body having an aperture 410. The first clamping member 408 is mounted on the first elongated member 122 in such a way that the aperture 410 of the first clamping member 408 is aligned with the first opening 402 of the first elongated member 122. However, diameter of the aperture 410 may be equal to or greater than the diameter of the first opening 402. The first clamping member 408 provides support to the second portion 306 while the first shear pin 302 is being inserted through the first opening 402. In one example, the first clamping member 408 may be made of an reinforced elastomeric material, so that the second portion 306 may be rigidly held by the first clamping member 408.

The first shear pin 302 further includes a first fracture zone 412. In one example, the first fracture zone 412 can include a first annular notch 414. The first annular notch 414 has a cross-section narrower than the cross-section of the second portion 306 of the first shear pin 302. As illustrated in FIG. 4, the first fracture zone 412 is formed in the second portion 306 of the first shear pin 302. Accordingly, when the first shear pin 302 is inserted through the first opening 402 and the second opening 404, the annular member 406 and the first clamping member 408 aids in positioning the first fracture zone 412 at the predetermined depth. For instance, when the first shear pin 302 is inserted through the aligned first opening 402 and the second opening 404, the insertion of the first shear pin 302 is ceased when the annular member 406 comes in contact with the first clamping member 408. Therefore, in order to position the first fracture zone 412 of the first shear pin 302 at the predetermined depth, in an example, the annular member 406 may be coupled at a predetermined position on the second portion 306 of the first shear pin 302.

As mentioned earlier, the second elongated member 124 is slidably disposed in the first elongated member 122 due to a difference in diameter between the first elongated member 122 and the second elongated member 124. Accordingly, during sliding movement of the second elongated member 124 in the first elongated member 122, a gap 'G' is maintained, along a radial direction, therebetween. In one example, the gap 'G' may be of one-fourth of an inch. In an embodiment, the strut assembly 102 further includes an annular spacer 416 disposed between an inner surface 'S2' of the first elongated member 122 and an outer surface 'S3' of the second elongated member 124. The annular spacer 416 is configured to define the gap 'G' between the first elongated member 122 and the second elongated member 124. In an example, the annular spacer 416 may be a ring that is disposed coaxially on the second elongated member 124. Further, a thickness of the annular spacer 416 may be equal to the difference in an inner diameter '$D_i$' of the first elongated member 122 and an outer diameter '$D_o$' of the second elongated member 124. In such an arrangement, the gap 'G' may be varied based on the thickness of the annular spacer 416. Further, the annular spacer 416 may be attached coaxially to the first elongated member 122, so that the annular spacer 416 is prevented from any displacement during a normal condition of the strut assembly 102. Further, the annular spacer 416 can also prevent sand particles, dust, and gravel, from entering into the gap 'G'.

With such an arrangement, the first fracture zone 412 is positioned at a desired depth in the gap 'G'. When the annular member 406 is coupled at the predetermined position on the first shear pin 302, the thickness of the first clamping member 408 may assist in positioning the first fracture zone 412 at the desired depth. Further, in an embodiment, the first shear pin 302 includes a third portion 418 that extends from the second portion 306. The third portion 418 is configured to extend through the second opening 404 defined in the second elongated member 124. The first fracture zone 412 is positioned between the second portion 306 and the third portion 418 of the first shear pin 302. As such, the cross-section of the first shear pin 302 decreases at the first fracture zone 412, while the cross-section of the second portion 306 and the third portion 418 remains the same.

Figure 5:
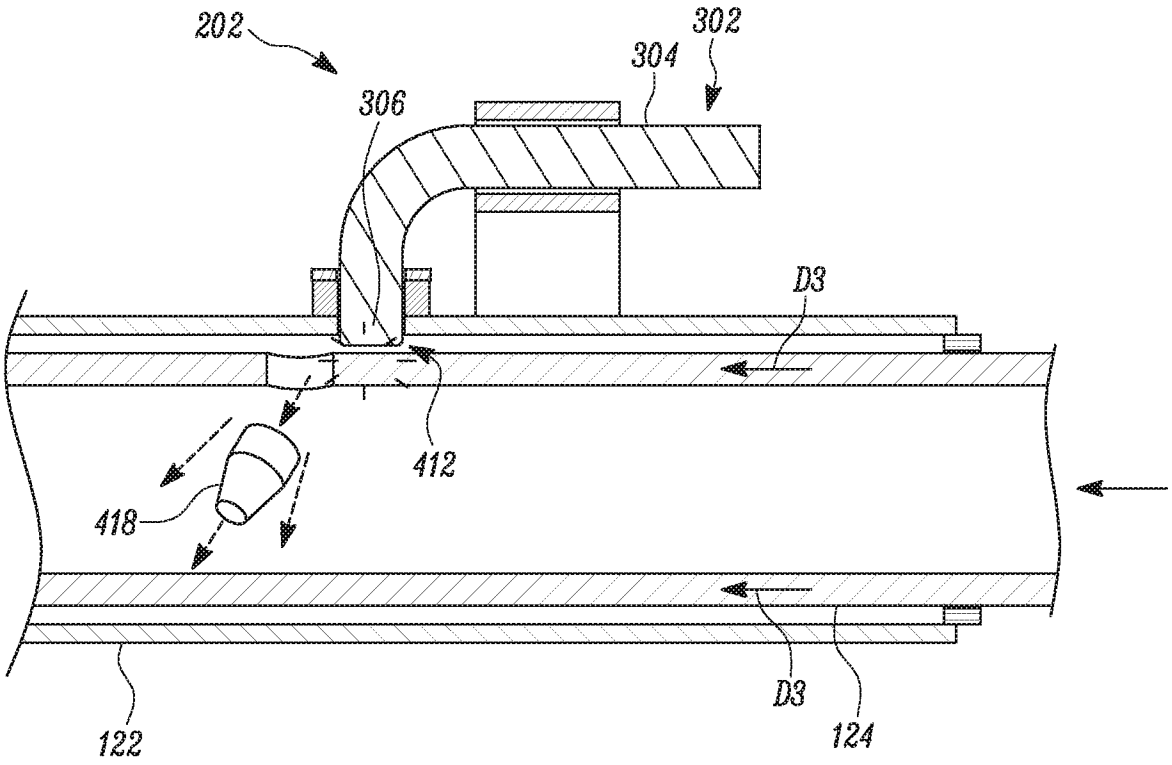
FIG. 5 is a sheared condition of a first shear pin of the first shear system, according to an embodiment of the present disclosure.

The third portion 418 of the first shear pin 302 is configured to shear off at the first fracture zone 412, when load acting on the implement 110 exceeds a threshold capability of the first shear pin 302, as shown in FIG. 5. For instance, when the implement 110 encounters an obstruction (not shown), for example a large rock, during the movement of the implement 110 over the ground surface, a resistance to movement of the implement 110 by the obstruction is experienced as the load by the implement 110. In situations where the implement 110 is unable to displace the obstruction, the load applied on the implement 110 is transmitted towards the frame 108 of the machine 100 through the strut assembly 102. Since one end of the second elongated member 124 is coupled to the implement 110, movement of the implement 110 due to the load causes the second elongated member 124 to slide in an inward direction 'D3'. Since the first elongated member 122 is coupled to the frame 108 of the machine 100, the first elongated member 122 remains stationary with respect to the second elongated member 124. As a result of the movement of the second elongated member 124 in the inward direction 'D3', the second opening 404 defined on the second elongated member 124 also moves, thereby deflecting the third portion 418 of the first shear pin 302 that extends through the second opening 404. Such movement, therefore, causes the third portion 418 to be sheared at the first fracture zone 412, as shown in FIG. 5. Subsequently, the third portion 418 gets disposed in the second elongated member 124. The phrase 'threshold capability' of the first shear pin 302 may be understood as a maximum load that can be resisted by the first shear pin 302 prior to its fracture, or shearing. It will be understood by a person skilled in the art that a feasible material having maximum Young's modulus may be selected to provide maximum resistance to deformation or fracture.

With reference to FIG. 3 to FIG. 5 and the description hereinabove, the second portion 306 of the first shear pin 302 extends in the direction perpendicular to the first portion 304. Accordingly, the first shear pin 302 can engage the first elongated member 122 with the second elongated member 124 when the first opening 402 is aligned with the second opening 404. However, it is to be understood that the above arrangement is for the purpose of the description and should not be construed as limited. In an embodiment, the second portion 306 of the first shear pin 302 may be inclined to the first portion 304 at an obtuse angle. In such a case, the first opening 402 and the second opening 404 may be accordingly defined on the first elongated member 122 and the second elongated member 124, respectively. Additionally, the first fracture zone 412 may also be formed in a manner, so that the third portion 418 of the first shear pin 302 shears off from the second portion 306 when the load acting on the implement 110 exceeds the threshold capability of the first shear pin 302. Additionally, in an example, multiple neighboring openings, like the first opening 402, may be defined in the first elongated member 122. Distance between two such consecutive first openings in the first elongated member 122 may be about 305 millimeters.

Figure 6:
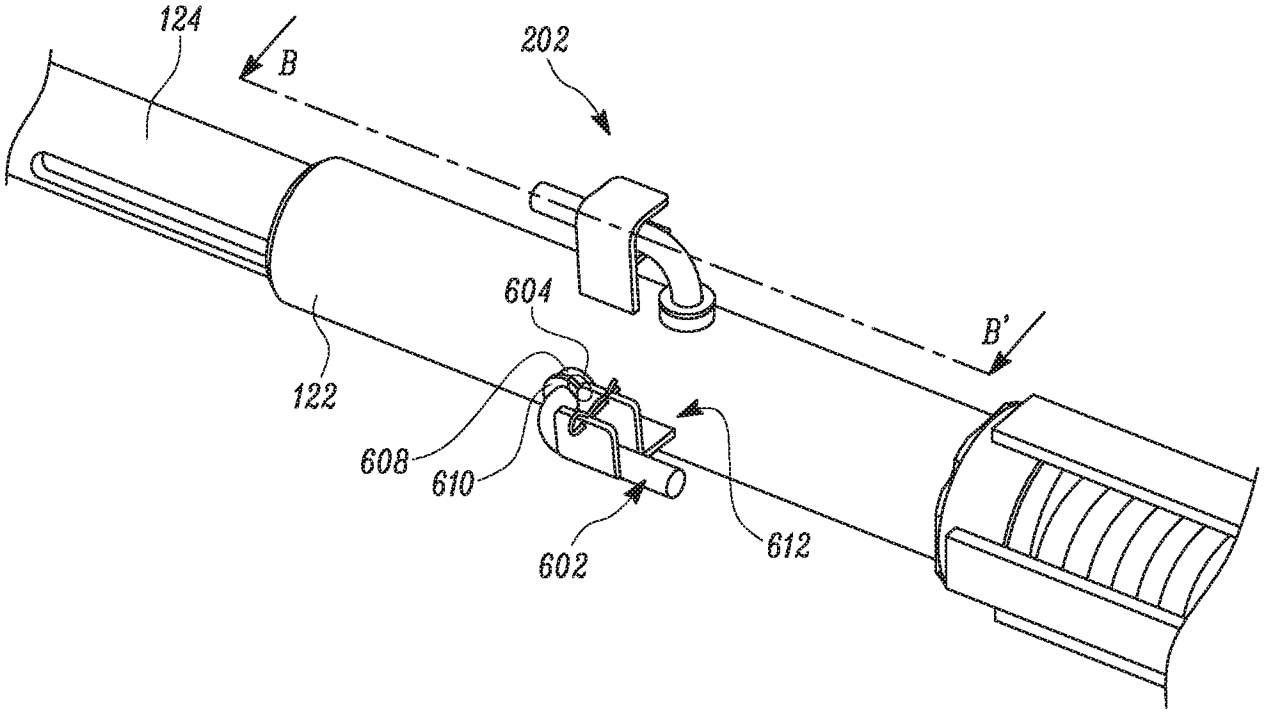
FIG. 6 is an enlarged perspective view of a second shear pin, according to an embodiment of the present disclosure.

FIG. 6 illustrates the first shear system 202 having a second shear pin 602, according to another embodiment of the present disclosure. The strut assembly 102 includes the second shear pin 602 in addition to the first shear pin 302. The second shear pin 602 has a design specification similar to that of the first shear pin 302. For the purpose of inserting the second shear pin 602 into the first elongated member 122, a third opening 604 is defined in the first elongated member 122. Further, the strut assembly 102 includes a second clamping member 608 to support the second shear pin 602. A second annular member 610 is coupled to the second shear pin 602 to position the second shear pin 602 at the predetermined depth. In addition, as shown in FIG. 6, the strut assembly 102 also includes a second holding member 612 to hold the second shear pin 602 intact.

Figure 7:
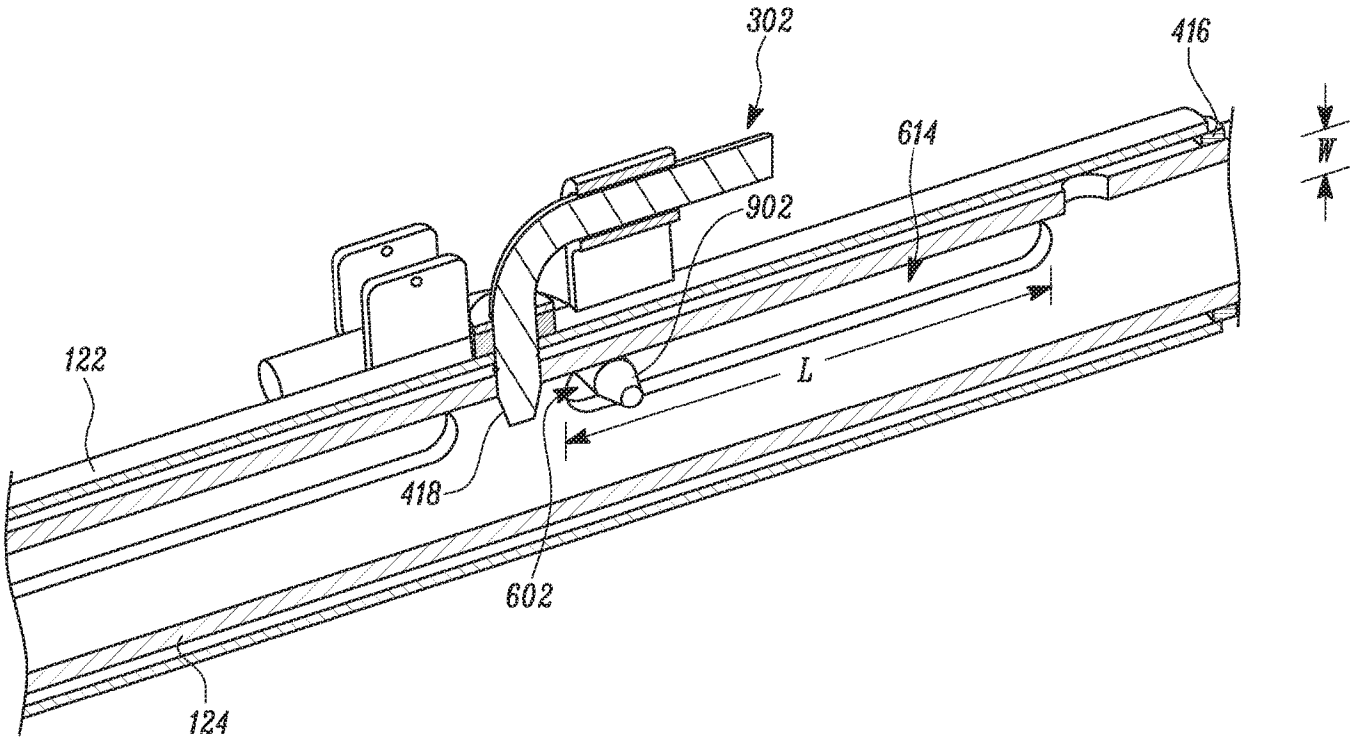
FIG. 7 is a cross-sectional view of the first shear system taken along a line B-B', according to an embodiment of the present disclosure.

A sectional view of the strut assembly 102 taken along line B-B' of FIG. 6 is shown in FIG. 7. The second elongated member 124 includes a longitudinal slot 614 having a length 'L' that extends along the length of the second elongated member 124. In an example, the width 'W' of the longitudinal slot 614 may be equal to or greater than a diameter of a third portion 902 of the second shear pin 602, such that the second shear pin 602 can be inserted into the second elongated member 124, as shown in FIG. 7. As such, the third opening 604 and the longitudinal slot 614 aids in inserting the second shear pin 602 into the first elongated member 122 and the second elongated member 124. In one example, a length of the longitudinal slot 614 may be about 213 millimeters (mm). Although the second portion of the second shear pin 602 is positioned in a direction perpendicular to the second portion 306 of the first shear pin 302 in the illustrated FIG. 7, it is to be understood that such arrangement is for the purpose of describing the alternate embodiment. The person skilled in the art may vary the design specification of the first and second elongated members 122, 124 illustrated and described herein to accommodate the first shear pin 602 and the second shear pin 302, albeit with few variations to the construction described herein.

Figure 8:
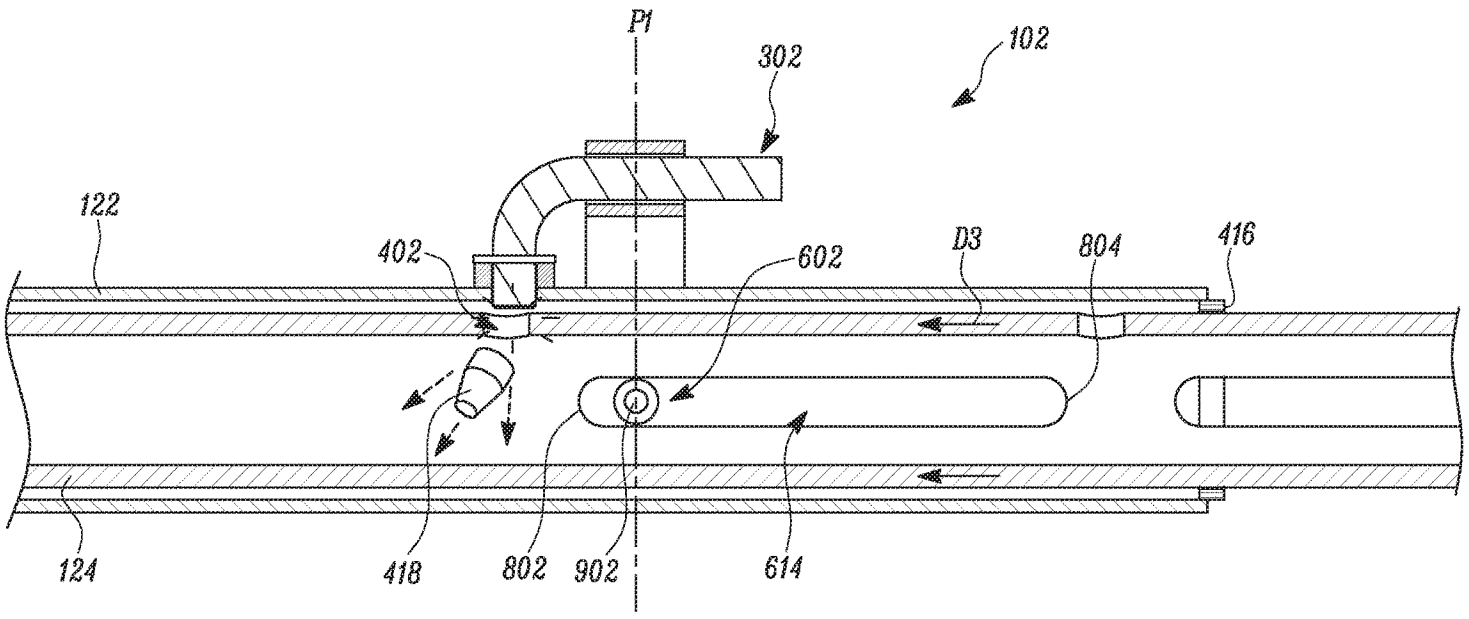
FIG. 8 is a sheared condition of the first shear pin of FIG. 7, according to an embodiment of the present disclosure.

FIG. 8 shows a cross-section of the strut assembly 102 of FIG. 7 illustrating shearing of the first shear pin 302. The longitudinal slot 614 and the second shear pin 602 are configured to allow movement of the second elongated member 124 from a first position 'P1' to a second position 'P2'. The second shear pin 602 is positioned proximate to a first end 802 of the longitudinal slot 614 in the first position 'P1' of the second elongated member 124. As described earlier, the third portion 418 of the first shear pin 302 shears off during the movement of the second elongated member 124 in the inward direction 'D3' when the load acting on the implement 110 exceeds the threshold capability of the first shear pin 302. Similarly, in the illustrated embodiment, the third portion 418 of the first shear pin 302 shears off owing to the movement of the second elongated member 124 in the inward direction 'D3'. The third portion 418 of the first shear pin 302 gets disposed in the second elongated member 124 post shearing.

Figure 9:
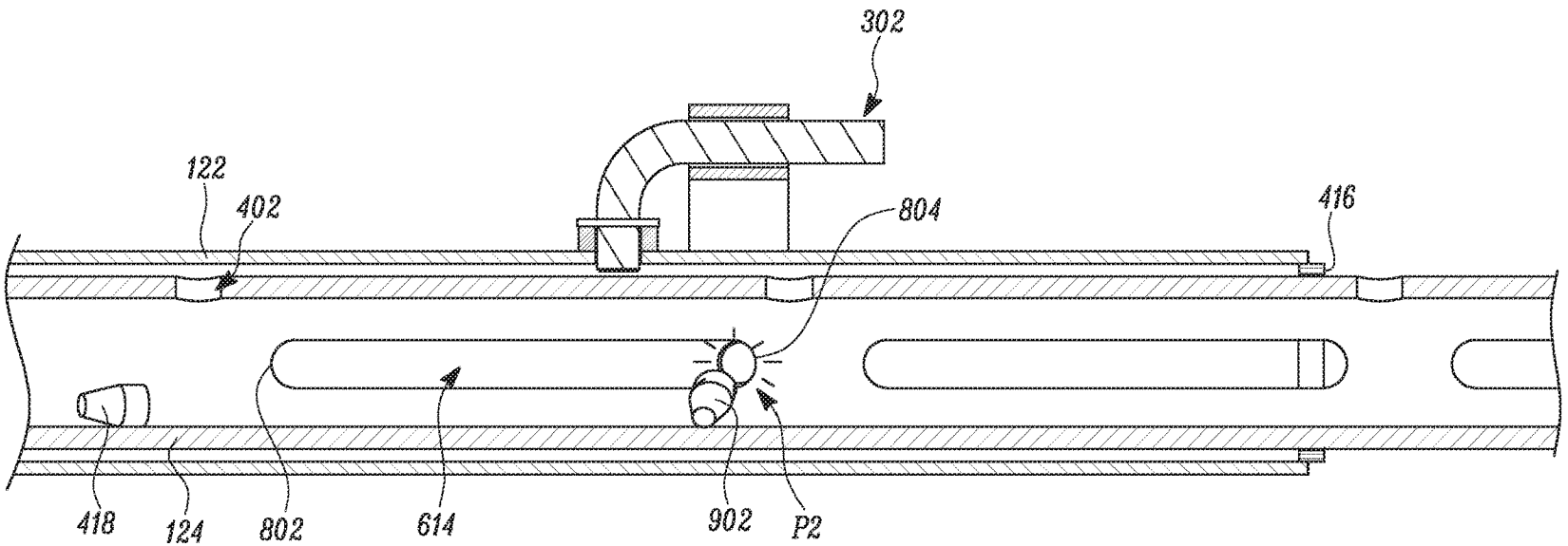
FIG. 9 is a sheared condition of the second shear pin of FIG. 7, according to an embodiment of the present disclosure.

Owing to further movement of the second elongated member 124 in the inward direction 'D3', a second end 804 of the longitudinal slot 614 approaches the second shear pin 602 at the second position 'P2' of the second elongated member 124. Further progressive movement of the second elongated member 124 in the inward direction 'D3' causes a third portion 902 of the second shear pin 602 to shear off, as shown in FIG. 9. Further, the third portion 902 of the second shear pin 602 gets disposed in the second elongated member 124. However, when the load being applied on the implement 110 decreases while the second end 804 of the longitudinal slot 614 approaches the second shear pin 602, the third portion 902 of the second shear pin 602 is retained without being sheared. In such a condition, the first elongated member 122 and the second elongated member 124 is allowed to travel, or float, between the first position 'P1' and the second position 'P2' without shearing the second shear pin 602.

Figure 10:
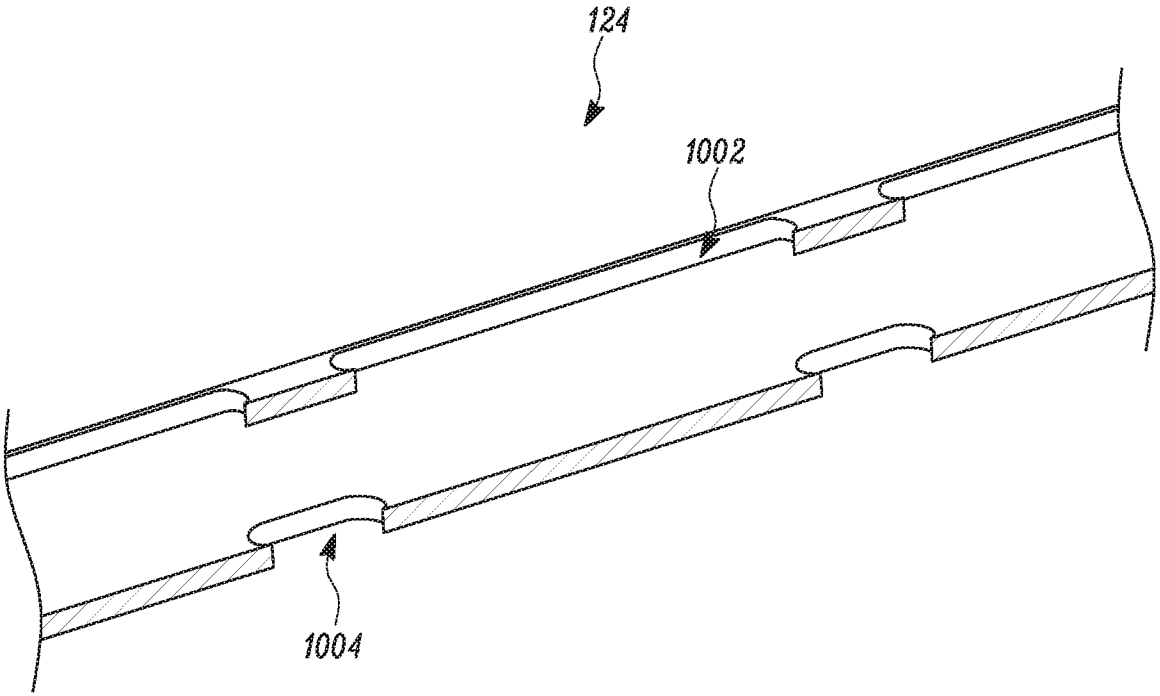
FIG. 10 is a cross-section of a second elongated member of the strut assembly, according to an embodiment of the present disclosure.

In yet another embodiment of the present disclosure, the second elongated member 124 may include two or more longitudinal slots on a periphery of the second elongated member 124. FIG. 10 shows a cross-section of the second elongated member 124 having one or more primary longitudinal slots and one or more secondary longitudinal slots formed along the length of the second elongated member 124. For the purpose of description, the one or more primary longitudinal slots and the one or more secondary longitudinal slots are hereinafter commonly referred to as the primary longitudinal slot 1002 and the second longitudinal slot 1004, respectively. In this embodiment, the primary longitudinal slot 1002 is lengthier than the secondary longitudinal slot 1004. In addition, the primary longitudinal slot 1002 and the secondary longitudinal slot 1004 are provided in a diagonally opposed manner in the second elongated member 124, as shown in FIG. 10. In one example, the second opening 404 defined in the second elongated member 124 may be expanded to form the primary longitudinal slot 1002. The secondary longitudinal slot 1004 may alternatively be referred to as a fifth opening 1004 defined in the second elongated member 124. During assembly of the strut assembly 102, the primary longitudinal slot 1002 is aligned with the first opening 402 defined in the first elongated member 122. Further, the width of the primary longitudinal slot 1002 and the secondary longitudinal slot 1002 is equal to or greater than the diameter of the first shear pin 302.

Figure 11:
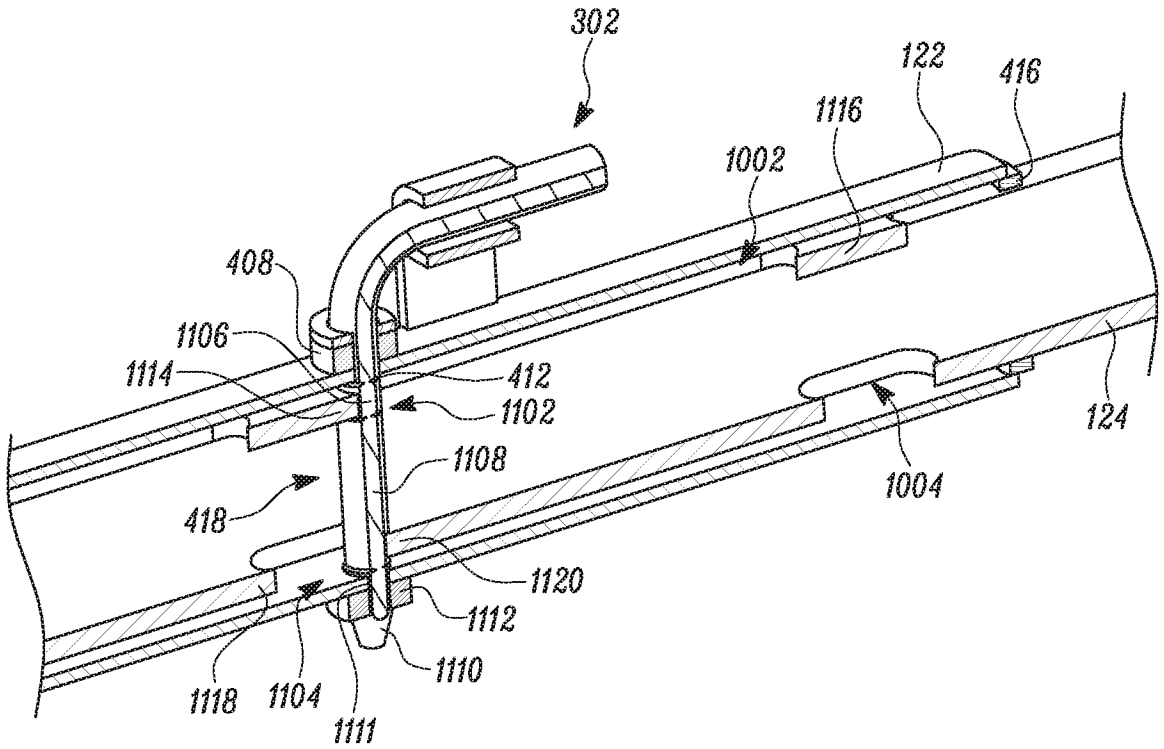
FIG. 11 is another embodiment of the first shear pin of the strut assembly.

In such an arrangement, the first shear pin 302 is inserted through the first opening 402 and the primary longitudinal slot 1002 to engage the first elongated member 122 with the second elongated member 124. FIG. 11 shows an embodiment where the third portion 418 of the first shear pin 302 is extended across the diameter of the second elongated member 124. The first shear pin 302, according to this embodiment, includes additional fracture zones provided along the length of the first shear pin 302. A second fracture zone 1102 and a third fracture zone 1104 are formed along the length of the third portion 418 of the first shear pin 302, in addition to the first fracture zone 412. In an example, the second fracture zone 1102 and the third fracture zone 1104 may include a second annular notch and a third annular notch, respectively. Further, the second fracture zone 1102 and the third fracture zone 1104 divides the third portion 418 of the first shear pin 302 into a first section 1106, a second section 1108, and a third section 1110. In an assembled condition of the first shear pin 302, the third section 1110 of the third portion 418 protrudes out through a fourth opening 1111 of the first elongated member 122, as shown in FIG. 11. Accordingly, a third clamping member 1112 is coupled to the first elongated member 122 to position the protruding portion of the third section 1110 of the third portion 418. As such, the third clamping member 1112 is coupled at a position diagonally opposite with respect to the first clamping member 408.

In an inserted condition of the first shear pin 302, a first end 1114 of the primary longitudinal slot 1002 is in contact with the first section 1106 of the third portion 418 and a second end 1116 of the primary longitudinal slot 1002 is distal from the first section 1106 of the third portion 418 due to the length of the primary longitudinal slot 1002. At a diagonally opposite end, a first end 1118 of the secondary longitudinal slot 1004 is distant from the second section 1108 of the third portion 418 and a second end 1120 of the secondary longitudinal slot 1004 is in contact with the second section 1108 of the third portion 418. A point at which the second end 1120 of the secondary longitudinal slot 1004 contacts the second section 1108 of the third portion 418, lies above the third fracture zone 1104. In order to achieve such an arrangement within the second elongated member 124, the annular member 406 can be coupled at a predetermined location on the first shear pin 302. Alternatively, the thickness of the first clamping member 408 can be varied to assist in positioning the fracture zones at desired depths.

Figure 12:
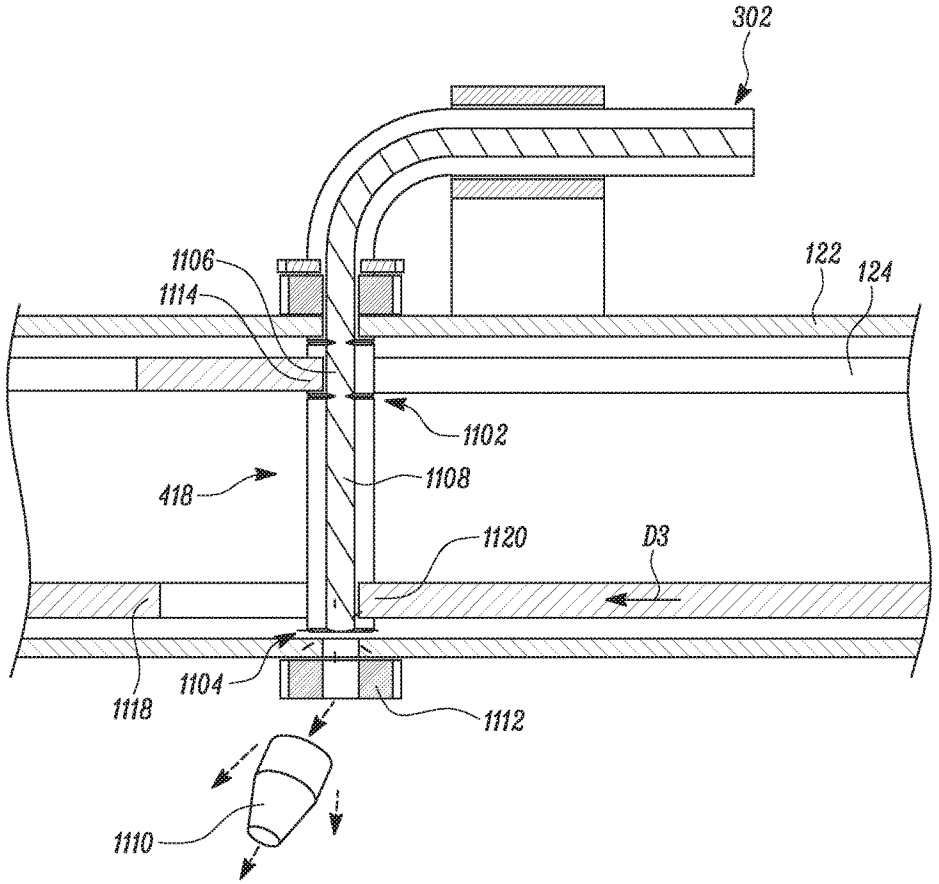
FIG. 12 is a sheared condition of a section of the first shear pin of FIG. 11, according to an embodiment of the present disclosure.

Further, as described earlier, when the implement 110 encounters the obstruction during the movement of the machine 100, load applied by the obstruction on the implement 110 causes the second elongated member 124 to slide in the inward direction 'D3' with respect to the first elongated member 122. Owing to such movement of the second elongated member 124 in the inward direction 'D3', the second end 1120 of the secondary longitudinal slot 1004 pushes the second section 1108 in the direction of movement of the second elongated member 124. Since the third section 1110 is restricted to movement by the fourth opening 1111 and the third clamping member 1112, the third section 1110 shears off at the third fracture zone 1104, from the second section 1108, when the second elongated member 124 moves in the inward direction 'D3', as shown in FIG. 12. The third section 1110 gets disposed off the third clamping member 1112 post shearing from the third fracture zone 1104.

Figure 13:
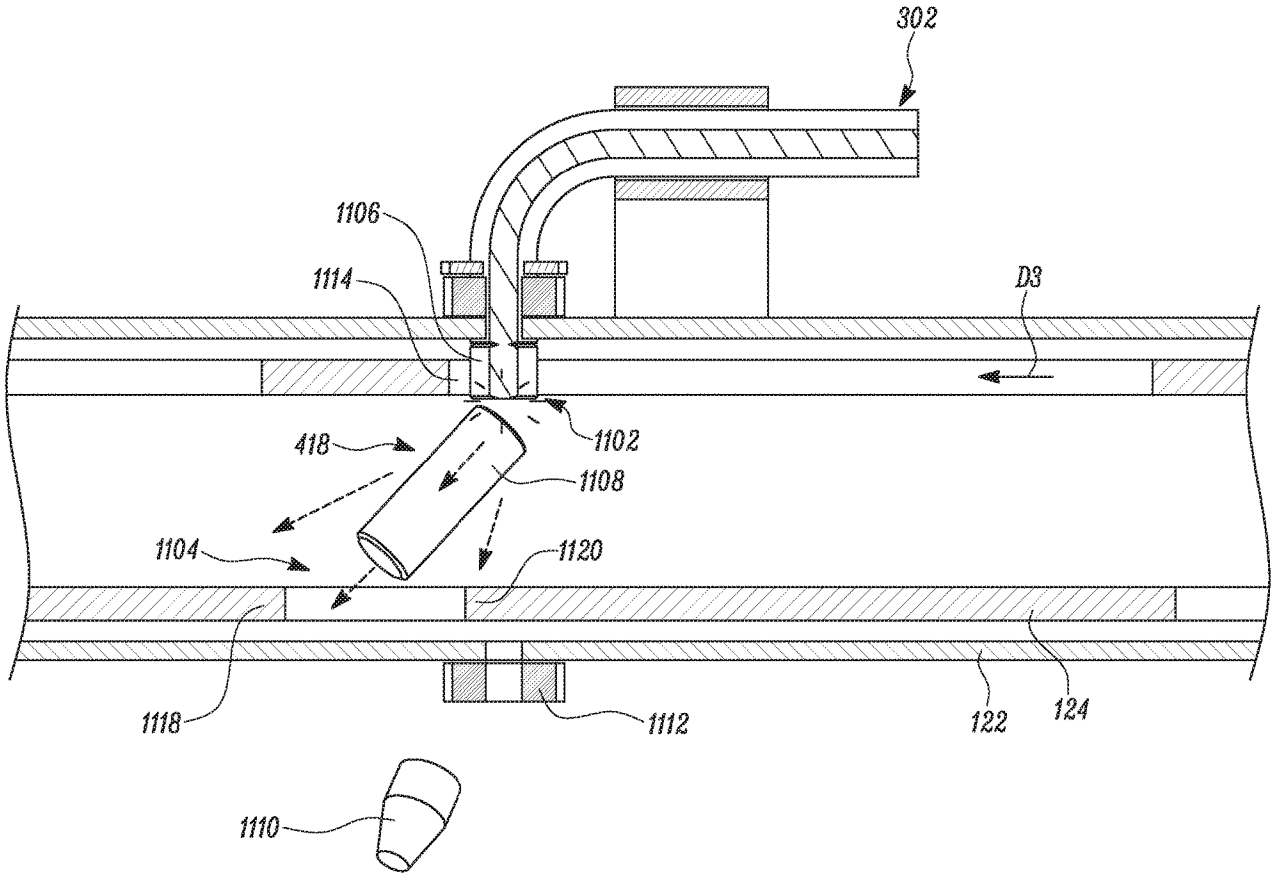
FIG. 13 is a sheared condition of an adjacent section of the first shear pin of FIG. 11, according to an embodiment of the present disclosure.
Figure 14:
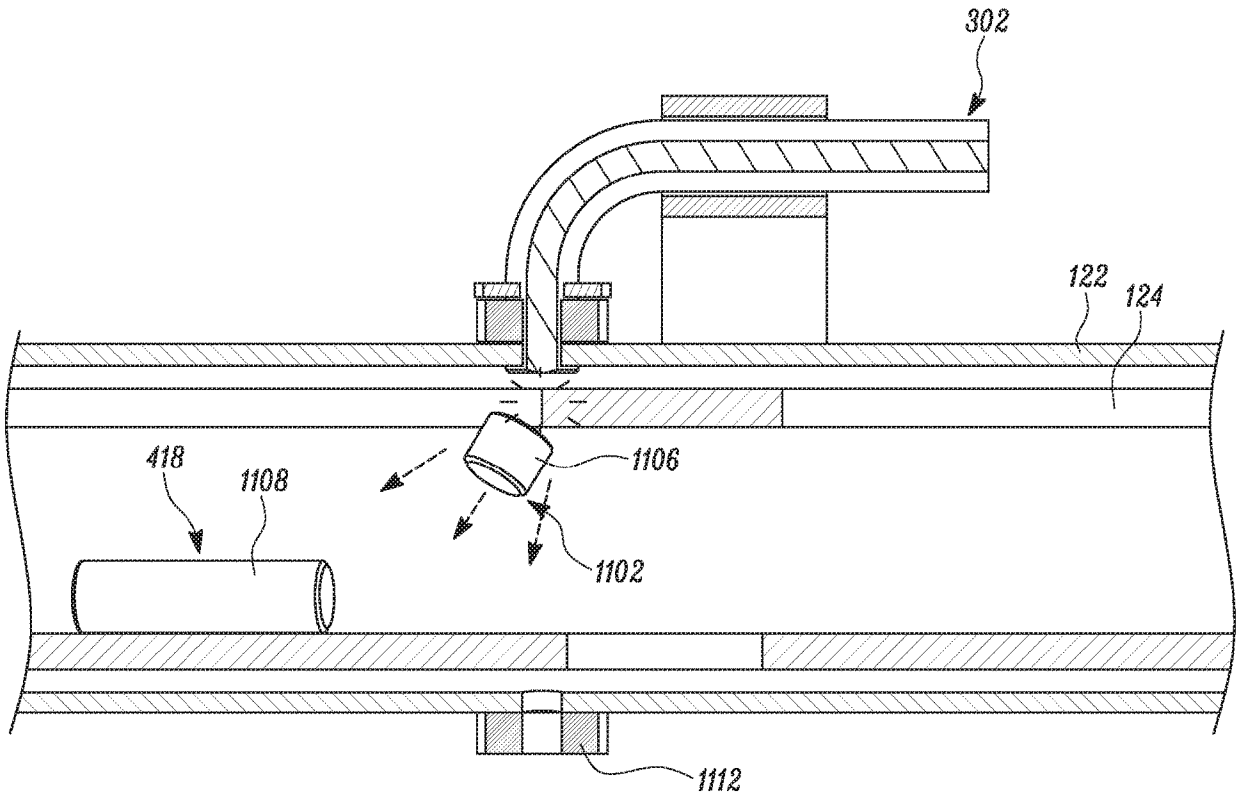
FIG. 14 is a sheared condition of another adjacent section of the first shear pin of FIG. 11, according to an embodiment of the present disclosure.

Further movement of the second elongated member 124 in the inward direction 'D3' causes the second section 1108 to shear off at the second fracture zone 1102, as shown in FIG. 13. Once sheared, the second section 1108 is disposed off within the second elongated member 124. Since the first section 1106 is attached to the second portion 306 of the first shear pin 302, the first section 1106 remains intact until the second end 1116 of the primary longitudinal slot 1002 approaches the first section 1106. However, due to further movement of the second elongate member in the inward direction 'D3', the second end 1116 contacts the first section 1106 of the third portion 418 and pushes the first section 1106 in the direction of movement of the second elongated member 124. As such, the first section 1106 is forced to shear off at the first fracture zone 412, as shown in FIG. 14.

Figure 15:
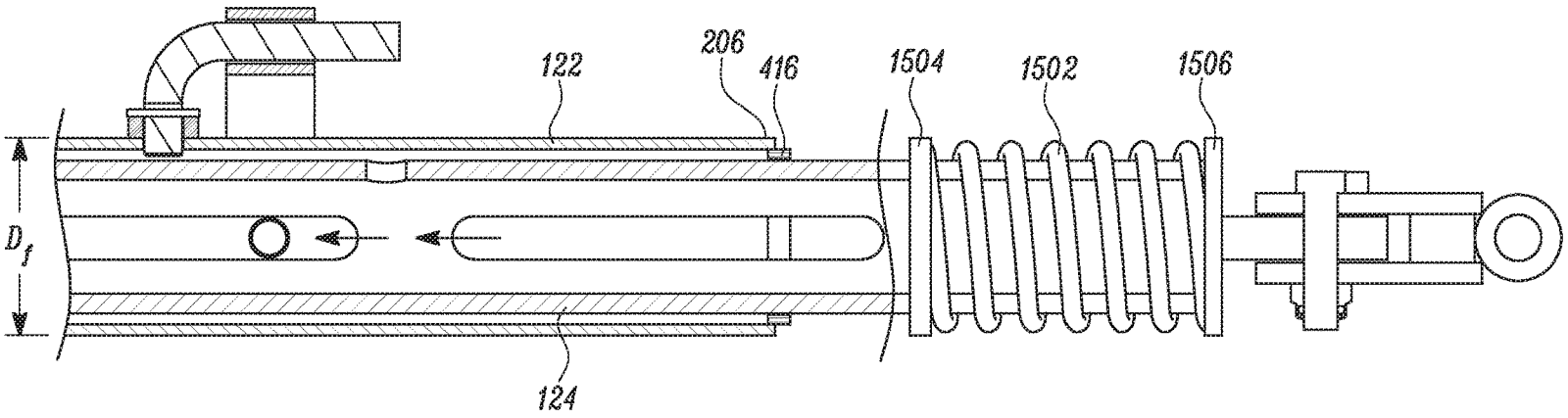
FIG. 15 is a planar view of the strut assembly having a damping member, according to an embodiment of the present disclosure.

In one implementation, the strut assembly 102 further includes a damping member 1502 disposed around the second elongated member 124, as shown in FIG. 15. In an example, the damping member 1502 may be a spring. The damping member 1502 is held in position by a first collar 1504 and a second collar 1506. In particular, the first collar 1504 and the second collar 1506 are disposed to the second elongated member 124, such that the ends of the damping member 1502 are in contact with the first collar 1504 and the second collar 1504. In an example, the first collar 1504 may be a floating collar and the second collar 1506 may be a stationary collar. Further, the first collar 1504 and the second collar 1506 are attached to a portion of an end of the second elongated member 124 that is coupled to the implement 110. In an example, the first collar 1504 and the second collar 1506 may be embodied as disc or circular plate-like structure having diameters greater than an outer diameter '$D_f$' of the first elongated member 122.

In addition, the first collar 1504 is disposed at a predetermined distance from the second end 206 of the first elongated member 122. When the implement 110 encounters the obstruction, the second elongated member 124 moves in the inward direction 'D3' to cause the third portion 418 of the first shear pin 302 to shear off. On covering the predetermined distance, the first collar 1504 is restricted in movement by the annular spacer 416. Accordingly, any further movement of the second elongated member 124 in the inward direction 'D3' causes the damping member 1502 to compress against the first collar 1504. As such, the damping member 1502 absorbs any further shocks which may be transmitted through the implement 110.

Figure 16:
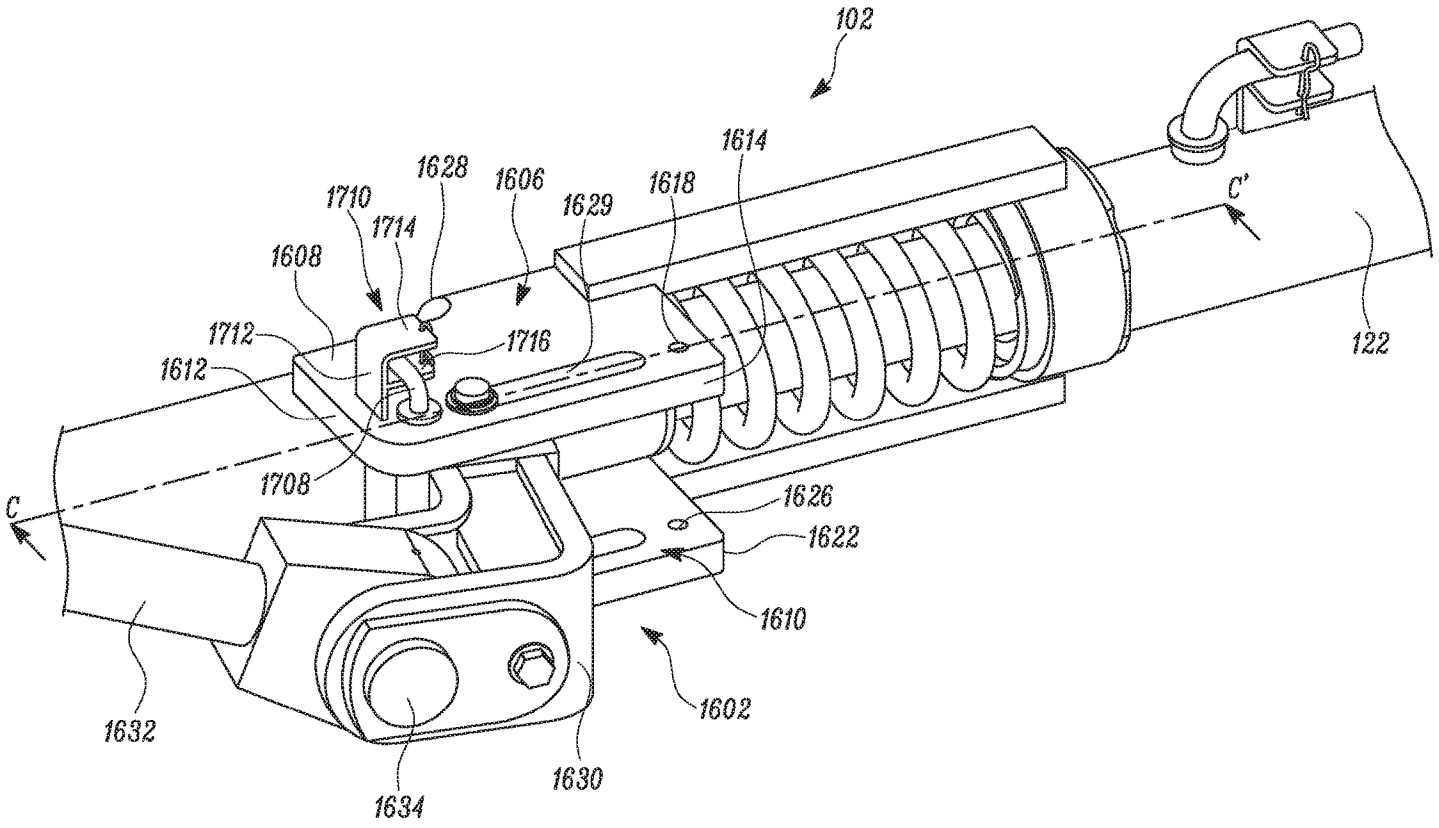
FIG. 16 is a perspective view of a second shear system of the strut assembly, according to an embodiment of the present disclosure.

FIG. 16 is a perspective view of the strut assembly 102 having a second shear system 1602, according to an embodiment of the present disclosure. The second shear system 1602 includes a first mounting bracket 1606 coupled to the first elongated member 122. In an example, the first mounting bracket 1606 may be coupled to the first elongated member 122 by welding or any other joining methods known in the art. The first mounting bracket 1606 includes a first flange 1608 and a second flange 1610. The first flange 1608 includes a first end 1612 and a second end 1614. The first end 1612 includes a first hole 1616 and the second end 1614 includes a second hole 1618. In an alternate embodiment, the second flange 1610 includes a first end (not shown) and a second end 1622. The first end may include a first hole (not shown) and the second end 1622 includes a second hole 1626. The first mounting bracket 1606 is embodied as a C shaped bracket having the first flange 1608 and the second flange 1610 extending from a base member 1628. The base member 1628 may be welded or bolted to the first elongated member 122. In one example, the first mounting bracket 1606 may be formed by a bending process, such that the first flange 1608 and the second flange 1610 extend in a direction perpendicular to the base member 1628. In another example, the first flange 1608, the second flange 1610, and the base member 1628 may be obtained as individual components and may be welded together to form the C shaped bracket. Due to such design specification of the first mounting bracket 1606, the first flange 1608 is at a predetermined distance from the second flange 1610. The predetermined distance may be equal to or greater than the outer diameter '$D_f$' of the first elongated member 122. The first mounting bracket 1606 further includes an elongated slot 1629 defined in the first flange 1608. The elongated slot 1629 extends in a direction along a width of the first flange 1608, as shown in FIG. 16.

The second shear system 1602 further includes a second mounting bracket 1630 coupled to the first mounting bracket 1606. The second mounting bracket 1630 is accommodated in the predetermined distance defined by the first flange 1608 and the second flange 1610 of the first mounting bracket 1606. For the purpose of coupling, the second mounting bracket 1630 is slidably received within the first mounting bracket 1606.

The strut assembly 102 further includes a linear actuator 1632. The linear actuator 1632 is coupled to the frame 108 of the machine 100. The linear actuator 1632 is configured to move the first elongated member 122 with respect to the frame 108 of the machine 100. The hydraulic system 114 supplies hydraulic fluid at desired pressure to the linear actuator 1632 through one or more control valves. In an example, the one or more control valves may either be electrically actuated or mechanically actuated. Further, a control lever (not shown) may be provided in the operator cabin 106 for actuating the one or more control valves. The second shear system 1602 is configured to engage the first elongated member 122 with the linear actuator 1632. The second mounting bracket 1630 is coupled to the linear actuator 1632 by a fastening member 1634. In an example, the second mounting bracket 1630 may be coupled to the linear actuator 1632 by the fastening member 1634 or any other fastening methods known in the art.

Figure 17:
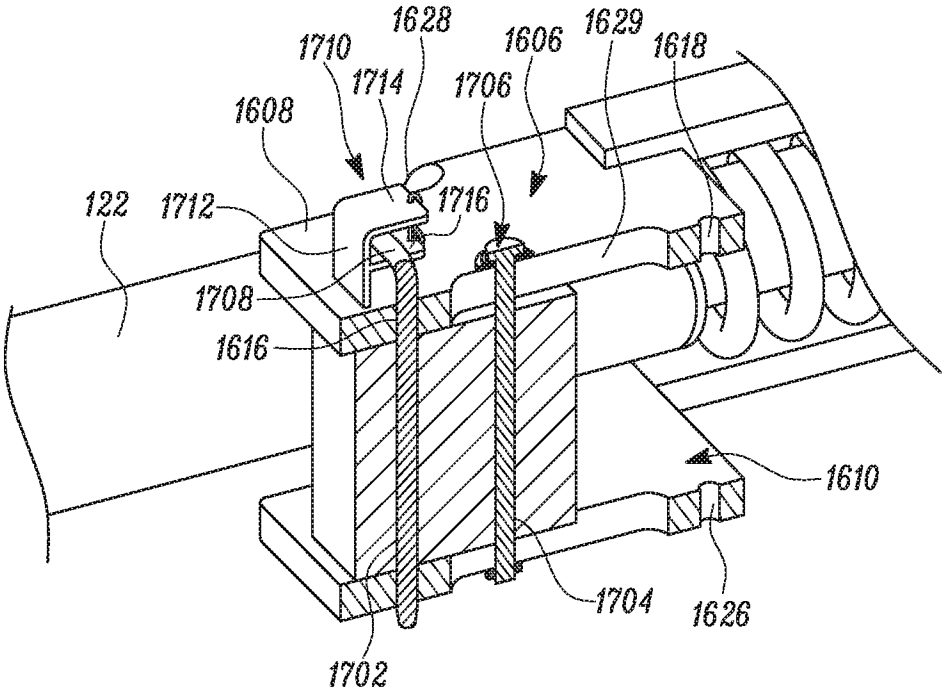
FIG. 17 is a cross-section of the second shear system taken along a line C-C', according to an embodiment of the present disclosure.

FIG. 17 illustrates a sectional view of the second shear system 1602 taken along a line C-C' of FIG. 16. The second mounting bracket 1630 further includes a first through-hole 1702 and a second through-hole 1704. During coupling of the second mounting bracket 1630 with the first mounting bracket 1606, the second through-hole 1704 is aligned with the elongated slot 1629 of the first mounting bracket 1606.

The second shear system 1602 further includes a sliding pin 1706 coupled to the second mounting bracket 1630. The sliding pin 1706 is configured to be slidably received in the elongated slot 1629 defined in the first flange 1608. In an example, the sliding pin 1706 may be a fastening member, such as a bolt and a rivet. Although FIG. 17 illustrates the sliding pin 1706 as a single fastening member being received in the elongated slot 1629, it will be understood that two such fastening members may be employed. In such a condition, one fastening member may support the first mounting bracket 1606 and the second mounting bracket 1630 from the first flange 1608. Likewise, another fastening member may support the first mounting bracket 1606 and the second mounting bracket 1630 from the second flange 1610. Further, each of the fastening members may extend to a certain length from the first and second flanges 1608, 1610.

The second shear system 1602 further includes a shear member 1708 configured to be inserted through the first hole 1616 defined in the first mounting bracket 1606 and the first through-hole 1702 defined in the second mounting bracket 1630. The shear member 1708 is configured to engage the first mounting bracket 1606 with the second mounting bracket 1630. In an embodiment, the second shear system 1602 further includes a second holding member 1710 to support and position the shear member 1708, when the shear member 1708 is employed to engage the first mounting bracket 1606 with the second mounting bracket 1630. The second holding member 1710 is mounted on the first flange 1608 and configured to removably receive the shear member 1708. For the purpose of supporting the shear member 1708, the second holding member 1710 includes a support member 1712, and a first arm 1714 and a second arm 1716 extending from the support member 1712. The support member 1712 is fixed on the first flange 1608 and extends from a surface of the first flange 1608. Further, the first arm 1714 and the second arm 1716 extend in a direction perpendicular to the support member 1712.

Figure 18:
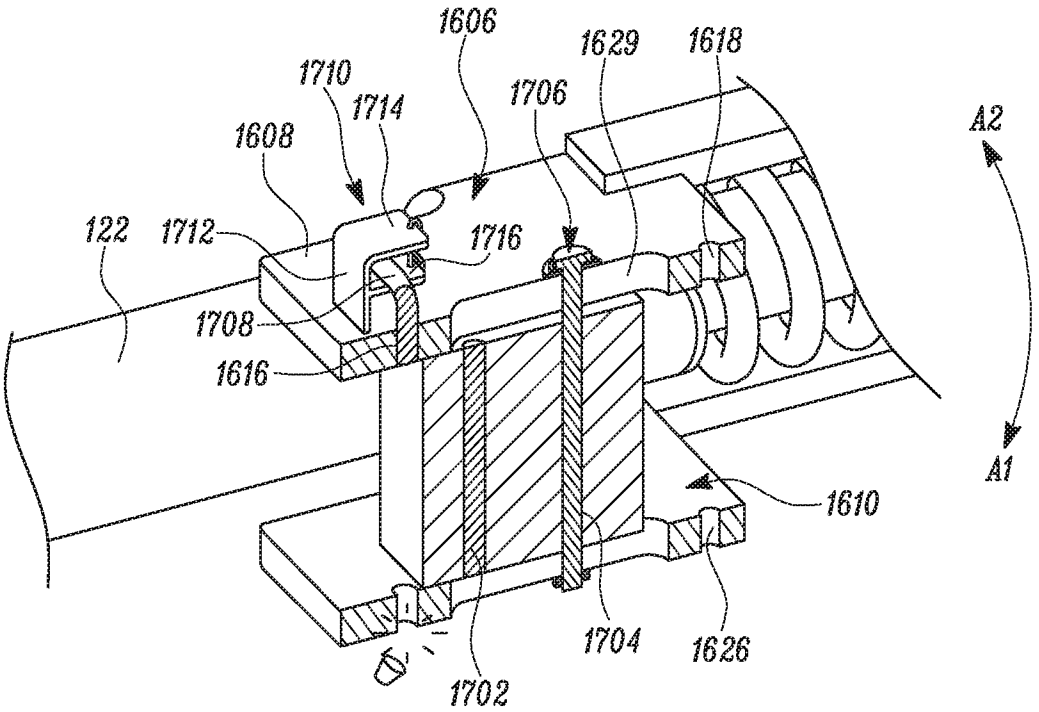
FIG. 18 is a sheared condition of a shear member of the second shear system, according to an embodiment of the present disclosure.

In cases where the implement 110 encounters the obstacle, the load applied by the obstacle on the implement 110 may cause the implement 110 to be displaced in a direction vertical with respect to the ground surface. Due to such vertical movement of the implement 110, the strut assembly 102 gets displaced angularly. In other words, the strut assembly 102 is displaced from a first angular position 'A1' to a second angular position 'A2'. In one example, the angular displacement may be about 10 degrees. Owing to such angular displacement of the strut assembly 102, the first mounting bracket 1606 also gets displaced angularly. In such a condition, the second mounting bracket 1630 is linearly displaced along the width of the first and second flange 1608, 1610 respectively. A combination of the angular displacement and the linear displacement causes a relative movement between the first mounting bracket 1606 and the second mounting bracket 1630, resulting in shearing off the shear member 1708 as shown in FIG. 18. Simultaneously, the sliding pin 1706 allows sliding of the second mounting bracket 1630 in the first mounting bracket 1606. As such, the sliding pin 1706 slides along the length of the elongated slot 1629 defined in the first mounting bracket 1606.

In one implementation, the shear member 1708 may include one or more fracture zones (not shown). For instance, the shear member 1708 may extend to a predefined length from the first flange 1608. In such a scenario, the fracture zone of the shear member 1708 may be positioned at a juncture between the first flange 1608 and the second mounting bracket 1630. The fracture zones aids in easy shearing of the shear member 1708 to allow movement of the first mounting bracket 1606 with respect to the second mounting bracket 1630. Further, the operator of the machine 100 may choose to use the shear member 1708 for engaging the first mounting bracket 1606 with the second mounting bracket 1630 for smooth operation of the implement 110. However, in cases where the shear member 1708 is not used, the implement 110 could cause the strut assembly 102 to float vertically with respect to the ground surface, thereby causing the implement 110 to trace an uneven path on the ground surface. For the purpose of replacing the shear member 1708 when sheared, an additional shear member (not shown) may be disposed in the first mounting bracket 1606. For example, the additional shear member may be disposed through the second hole 1618 of the first flange 1608 and the second hole 1626 of the second flange 1610.

Various embodiments disclosed herein are to be taken in the illustrative and explanatory sense, and should in no way be construed as limiting of the present disclosure.

INDUSTRIAL APPLICABILITY

The present disclosure relates to the strut assembly 102 for coupling the implement 110 to the frame 108 of the machine 100. Owing to the presence of the first shear system 202 and the second shear system 1602, impact caused by the obstacle, on the implement 110, during the movement of the machine 10 is restricted from transferring to the frame 108 of the machine 100 due to shearing of the first shear pin 302 and the second shear pin 602 of the respective first and second shear systems 202, 1602. As such, the impact is prevented from being transmitted to the frame 108 of the machine 100, and resetting of the first and second shear systems 202, 1602 after shearing of the first and second shear pin 302, 602, respectively, become easy for an operator.

The sheared pin or the shear member can be easily replaced with the additional shear member by raising or lowering the implement to a predetermined height, which otherwise required more efforts by the operator of the machine 100. Such configuration of the strut assembly 102 of the present disclosure provides a cost effective means for coupling the implement 110 to the frame 108 of the machine 100. The configuration of the strut assembly 102 eliminates the requirement of a strut retaining cable, which was otherwise employed to support the strut assembly 102.

As described above, according to one embodiment of the present disclosure, the first shear pin 302 for engaging the first elongated member 122 with the second elongated member 124 is provided. The shearing of the first shear pin 302 minimizes shock and load from being transmitted from the implement 110 to the machine 100. According to another embodiment of the present disclosure, the first shear pin 302 extends along the diameter of the first elongated member 122 and the second elongated member 124. Such configuration of the first shear pin 302 allows stage-wise shearing of the first shear pin 302, thereby minimizing magnitude of shock or load transmitted from the implement 110 to the machine 100.

According to yet another embodiment of the present disclosure, the second shear pin 602 is provided in addition to the first shear pin 302. The second shear pin 602 aids in further minimizing the impact being transmitted from the implement 110 to the machine 100. In addition, the longitudinal slot 614 and the second shear pin 602 allows for travel of the second elongated member 124 before shearing the second shear pin 602. Furthermore, according to yet another embodiment of the present disclosure, the second shear system 1602 is provided. The shear member 1708 of the second shear system 1602 aids in further minimizing the impact being transmitted from the implement 110 to the machine 100. As such, the magnitude of the impact is almost nullified, thereby preventing any damage to the machine 100.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A strut assembly for coupling an implement to a frame of a machine, the strut assembly comprising:

a first elongated member configured to couple to the frame of the machine;

a second elongated member slidably disposed within the first elongated member, the second elongated member configured to couple to the implement; and a shear system configured to engage the second elongated member with the first elongated member, the shear system comprising:

a first shear pin configured to be inserted through a first opening defined in the first elongated member and a second opening defined in the second elongated member, the first shear pin comprising a first fracture zone positioned within a gap defined between the first elongated member and the second elongated member, wherein the first shear pin includes a first portion;

a second portion extending in a direction perpendicular to the first portion, and configured to extend through the first opening defined in the first elongated member; and a third portion extending from the second portion and configured to extend through the second opening defined in the second elongated member, wherein the first fracture zone is defined between the second portion and the third portion, and wherein the third portion is configured to shear off from the second portion at a location of the first fracture zone when load acting on the implement exceeds a threshold capability of the first shear pin, and wherein the shear system comprises an annular member coupled to the second portion of the first shear pin, and wherein the annular member is supported on a clamping member to position the first fracture zone within the gap.

2. The strut assembly of claim 1, wherein the clamping member is configured to position the first shear pin at a predetermined depth.

3. The strut assembly of claim 1, wherein the first fracture zone further comprises a first annular notch positioned within the gap.

4. The strut assembly of claim 1 comprising an annular spacer disposed between an inner surface of the first elongated member and an outer surface of the second elongated member, the annular spacer configured to define the gap between the first elongated member and the second elongated member.

5. The strut assembly of claim 1, wherein the shear system comprises a holding member having a first arm and a second arm, the holding member being mounted on the first elongated member and configured to removably receive the first portion of the first shear pin between the first arm and the second arm thereof.

6. The strut assembly of claim 1 comprising a damping member disposed around the second elongated member, the damping member configured to restrain movement of the second elongated member within the first elongated member when the first shear pin is sheared off.

7. The strut assembly of claim 1, wherein the shear system comprises a second shear pin configured to be inserted through a third opening defined in the first elongated member and a longitudinal slot defined in the second elongated member, and wherein the second shear pin is supported on a second clamping member.

8. The strut assembly of claim 7, wherein the longitudinal slot and the second shear pin are configured to allow movement of the second elongated member from a first position to a second position with respect to the first elongated member when the first shear pin is sheared off.

9. A strut assembly for coupling an implement to a frame of a machine, the strut assembly comprising:

a first elongated member configured to couple to the frame of the machine;

a second elongated member slidably disposed within the first elongated member and configured to couple to the implement;

a linear actuator coupled to the frame of the machine and configured to move the first elongated member relative to the frame;

a first shear system configured to engage the second elongated member with the first elongated member, the first shear system comprising:

a first shear pin configured to be inserted through a first opening defined in the first elongated member and a second opening defined in the second elongated member, the first shear pin comprising a first fracture zone positioned within a gap defined between the first elongated member and the second elongated member; and a second shear system configured to engage the second elongated member with the linear actuator, the second shear system comprising:

a first mounting bracket coupled to the first elongated member;

a second mounting bracket coupled to the linear actuator and slidably received within the first mounting bracket;

a sliding pin coupled to the second mounting bracket and configured to slidably receive through an elongated slot defined in the first mounting bracket; and a shear member configured to be inserted through a first hole defined in the first mounting bracket and a first through-hole defined in the second mounting bracket, and configured to engage the first mounting bracket with the second mounting bracket, wherein the first shear pin includes a first portion;

a second portion extending in a direction perpendicular to the first portion, and configured to extend through the first opening defined in the first elongated member; and a third portion extending from the second portion and configured to extend through the second opening defined in the second elongated member, wherein the first fracture zone is defined between the second portion and the third portion, and wherein the third portion is configured to shear off from the second portion at the location of the first fracture zone when a load acting on the implement exceeds a threshold capability of the first shear pin, and wherein the first shear system comprises an annular ring member coupled to the second portion of the first shear pin, and wherein the annular ring member is supported on a first clamping member to position the first fracture zone within the gap.

10. The strut assembly of claim 9 comprising an annular spacer disposed between an inner surface of the first elongated member and an outer surface of the second elongated member, the annular spacer configured to define the gap between the first elongated member and the second elongated member.

11. The strut assembly of claim 9, wherein the first clamping member is configured to position the first shear pin at a predetermined depth.

12. The strut assembly of claim 9, wherein the first shear system comprises a holding member having a first arm and a second arm, the holding member mounted on the first elongated member, and configured to removably receive the first portion of the first shear pin between the first arm and the second arm thereof.

13. The strut assembly of claim 9, wherein the elongated slot and the sliding pin are configured to allow the implement to float between a first angular position and the second angular position when the shear member is sheared off.

14. A machine comprising:

a frame;

a first elongated member configured to couple to the frame;

a second elongated member slidably received within the first elongated member, and configured to couple to an implement;

a linear actuator coupled to the frame, and configured to move the first elongated member relative to the frame;

a first shear system configured to engage the second elongated member with the first elongated member, the first shear system comprising:

a first shear pin supported on a clamping member, and configured to insert through a first opening defined in the first elongated member and a second opening defined in the second elongated member, the first shear pin comprises a first fracture zone positioned within a gap defined between the first elongated member and the second elongated member; and a second shear system configured to engage the second elongated member with the linear actuator, the second shear system comprising:

a first mounting bracket coupled to the first elongated member;

a second mounting bracket coupled to the linear actuator, and slidably received within the first mounting bracket;

a sliding pin coupled to the second mounting bracket, and configured to slidably receive through an elongated slot defined in the first mounting bracket; and a shear member configured to be inserted through a first hole defined in the first mounting bracket and a first through-hole defined in the second mounting bracket, and configured to engage the first mounting bracket with the second mounting bracket.

15. The machine of claim 14, wherein the first shear pin comprises:

a first portion;

a second portion extending in a direction perpendicular to the first portion, and configured to extend through the first opening defined in the first elongated member; and a third portion extending from the second portion and configured to extend through the second opening defined in the second elongated member, wherein the first fracture zone is defined between the second portion and the third portion, and wherein the third portion is configured to shear off from the second portion at the location of the first fracture zone when a load acting on the implement exceeds a threshold capability of the first shear pin.

16. The machine of claim 14, wherein the elongated slot and the sliding pin are configured to allow the implement to float between a first angular position and the second angular position when the shear member is sheared off.

* * * * *